US009938689B2

(12) United States Patent
Chaston et al.

(10) Patent No.: US 9,938,689 B2
(45) Date of Patent: Apr. 10, 2018

(54) COORDINATED IMPLEMENT CONTROL FOR WORK VEHICLE

(71) Applicant: Deere & Company, Moline, IL (US)

(72) Inventors: Keith N. Chaston, Dubuque, IA (US); Lance R. Sherlock, Asbury, IA (US); Nathan J. Horstman, Durango, IA (US); David A. Veasy, Dubuque, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 14/882,259

(22) Filed: Oct. 13, 2015

(65) Prior Publication Data

US 2017/0101762 A1 Apr. 13, 2017

(51) Int. Cl.
*E02F 3/84* (2006.01)
*E02F 3/76* (2006.01)

(52) U.S. Cl.
CPC ..... *E02F 3/844* (2013.01); *E02F 3/7604* (2013.01); *E02F 3/7636* (2013.01)

(58) Field of Classification Search
None
See application file for complete search history.

(56) References Cited

U.S. PATENT DOCUMENTS 3,880,243 A 4/1975 Gurries et al.
4,643,261 A 2/1987 Long
6,293,354 B1 9/2001 Garratt et al.
6,354,023 B1 * 3/2002 Trahan ..... E01H 4/02 37/219
8,948,977 B2 * 2/2015 Liu ..... E02F 9/265 180/170
9,085,877 B2 * 7/2015 Wahlmark ..... E02F 3/764
2010/0108336 A1 * 5/2010 Thomson ..... E02F 3/7663 172/795
2013/0087349 A1 * 4/2013 Hayashi ..... E02F 9/2029 172/2
2013/0180744 A1 * 7/2013 Favreau ..... E02F 3/7668 172/780

FOREIGN PATENT DOCUMENTS

EP 0123549 A2 10/1984
WO WO-2005120206 A1 * 12/2005 ..... A01B 31/00

* cited by examiner

*Primary Examiner* — Thomas G Black
*Assistant Examiner* — Demetra R Smith-Stewart
(74) *Attorney, Agent, or Firm* — Lorenz & Kopf, LLP

(57) ABSTRACT

A coordinated control method and system for a work vehicle having a primary implement and a secondary implement and one or more controllers. The controller(s) receive a primary implement position input, which is used to generate a primary implement control command to drive one or more primary actuators to position the primary implement. The controller(s) generate a secondary implement control command that is coordinated with the primary implement position input to drive one or more secondary actuators to position the secondary implement in a relative orientation with respect to an orientation of the primary implement resulting from the primary implement control command.

20 Claims, 8 Drawing Sheets

COORDINATED IMPLEMENT CONTROL FOR WORK VEHICLE

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to work vehicles and the coordinated control of multiple implements.

BACKGROUND OF THE DISCLOSURE

Off-road work vehicles of various types may have one or more implements for carrying out various work operations. Motor graders, for example, may have a main blade, sometimes referred to as a "moldboard," for performing ground clearing or smoothing operations. Such motor graders may also have other implements, such as a scarifiers, rippers or other blades, that may be used to perform other ground working operations (e.g., ground loosening or other ground clearing or smoothing operations) before, during or after the operation performed by the main blade.

SUMMARY OF THE DISCLOSURE

The disclosure provides a system and method for controlling multiple implements of a work vehicle in a coordinated manner based on a position input to a primary implement.

In one aspect the disclosure provides a coordinated implement control method for a work vehicle having a primary implement and a secondary implement. The method includes receiving, by one or more controllers, a primary implement position input, and generating, by the one or more controllers, a primary implement control command to drive one or more primary actuators to position the primary implement according to the primary implement position input. The method also includes generating, by the one or more controllers, a secondary implement control command that is coordinated with the primary implement position input. The secondary implement control command is generated to drive one or more secondary actuators to position the secondary implement in a relative orientation with respect to an orientation of the primary implement resulting from the primary implement control command.

In another aspect the disclosure provides a coordinated blade control method for a motor grader having a primary blade and a secondary blade. The method includes receiving, by one or more controllers, a primary blade position input, and generating, by the one or more controllers, a primary blade control command to drive one or more primary actuators to position the primary blade according to the primary blade position input. The method also includes generating, by the one or more controllers, a secondary blade control command that is coordinated with the primary blade position input. The secondary blade control command is generated to drive one or more secondary actuators to position the secondary blade in a relative orientation with respect to an orientation of the primary blade resulting from the primary blade control command.

In yet another aspect the disclosure provide a coordinated multi-blade control system for a motor grader having a primary blade and a secondary blade. The blade control system includes one or more controllers. The controller(s) are configured to receive a primary blade position input, and generate a primary blade control command to drive one or more primary actuators to position the primary blade according to the primary blade position command. The controller(s) are also configured to generate a secondary blade control command that is coordinated with the primary blade position input. The secondary blade control command is generated to drive one or more secondary actuators to position the secondary blade in a relative orientation with respect to an orientation of the primary blade resulting from the primary blade control command.

The details of one or more embodiments are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
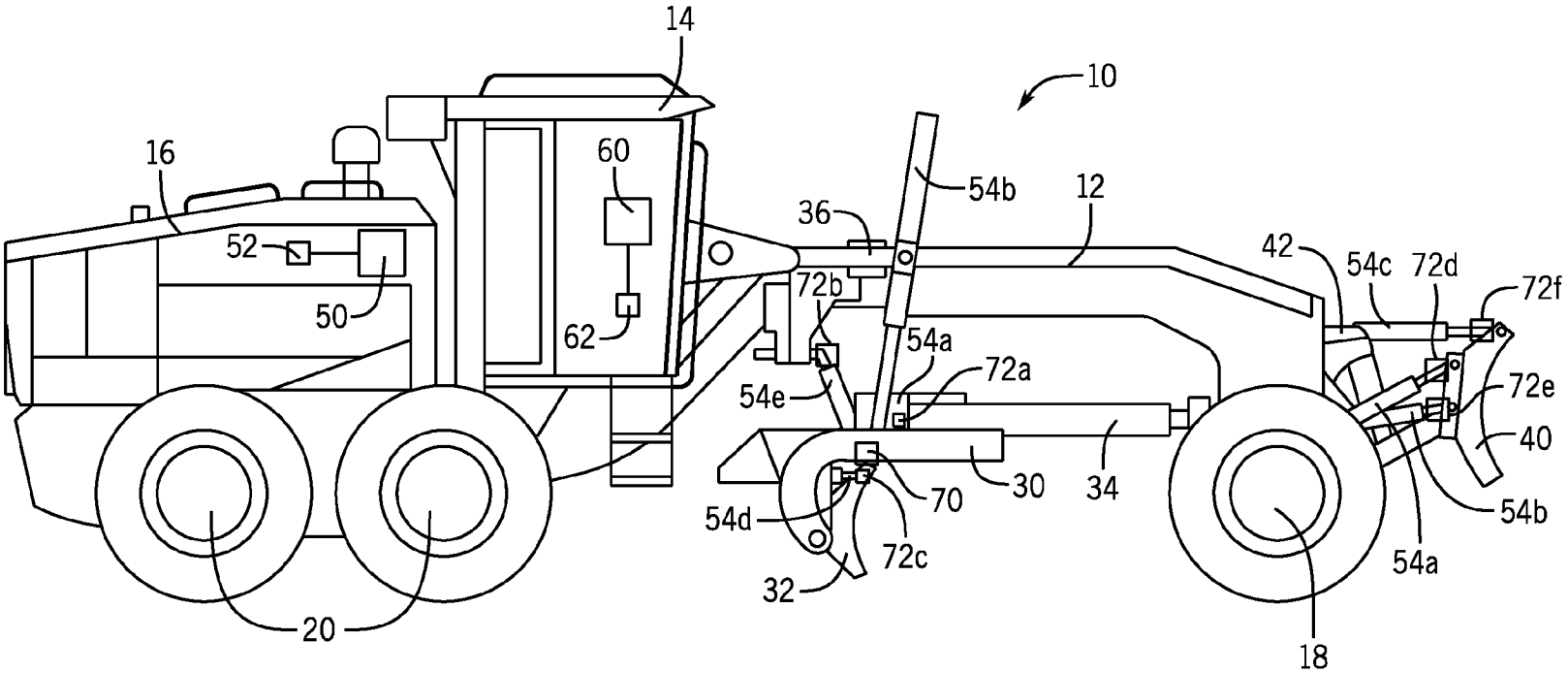
FIG. 1 is a side view of an example work machine in the form of a motor grader, having multiple implements in the form of a main blade and a front blade, in which the disclosed coordinated implemented control system and method may be used.

The following describes one or more example embodiments of the disclosed coordinated implement control system and method, as shown in the accompanying figures of the drawings described briefly above. Various modifications to the example embodiments may be contemplated by one of skill in the art.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

Furthermore, in detailing the disclosure, terms of direction and orientation, such as "forward," "aft," "lateral," "horizontal," and "vertical" may be used. Such terms are defined, at least in part, with respect to the direction in which the tillage implement is towed or otherwise moves during use. The term "forward" and the abbreviated term "fore" (and any derivatives and variations) refer to a direction corresponding to the direction of travel of the tillage implement, while the term "aft" (and derivatives and variations) refer to an opposing direction. The term "fore-aft axis" may also reference an axis extending in fore and aft directions. By comparison, the term "lateral axis" may refer to an axis that is perpendicular to the fore-aft axis and extends in a horizontal plane; that is, a plane containing both the fore-aft and lateral axes. The term "vertical," as appearing herein, refers to an axis or a direction orthogonal to the horizontal plane containing the fore-aft and lateral axes.

As used herein, the term module refers to any hardware, software, firmware, electronic control component, processing logic, and/or processor device, individually or in any combination, including without limitation: application specific integrated circuit (ASIC), an electronic circuit, a processor (shared, dedicated, or group) and memory that executes one or more software or firmware programs, a combinational logic circuit, and/or other suitable components that provide the described functionality.

Embodiments of the present disclosure may be described herein in terms of functional and/or logical block components and various processing steps. It should be appreciated that such block components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the present disclosure may be practiced in conjunction with any number of systems, and that the motor grader described herein is merely one exemplary embodiment of the present disclosure.

For the sake of brevity, conventional techniques related to signal processing, data transmission, signaling, control, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in an embodiment of the present disclosure.

The following describes one or more example implementations of the disclosed system for controlling multiple implements of a work vehicle in a coordinated manner, as shown in the accompanying figures of the drawings described briefly above. Generally, the disclosed control system and method (and work vehicles in which they are implemented) allow for improved operator control and functioning of multiple implements of a work vehicle, as compared to conventional systems.

Generally, an implement may be movable with respect to a work vehicle (or other work machine) by various actuators in order to accomplish tasks with the implement. Discussion herein may sometimes focus on the example application of moving implements configured as blades of a motor grader, with actuators for moving the blades generally configured as hydraulic cylinders. In other applications, other configurations are also possible. In some embodiments, for example, one or more of the implements may not be a blade, instead, for example the implement may be a scarifier, a ripper or other known implement. Likewise, work vehicles in some embodiments may be configured as tractors, loaders, dozers or similar machines.

The disclosed control system may be used to receive operator commands for movement of implements (e.g., in one or more of lowered/raised height positions, left/right lateral positions, front/back fore-aft positions, clockwise/counterclockwise rotated (or "steer angle") positions, and up/down slope (or "tilt angle") positions) in which case the control system determines a movement associated with the implement(s) based on the receipt of the operator commands. The control system may also determine an implement movement based on feedback input, including input signals from one or more sensors associated with the implements. A Global Positioning System (GPS) may be used to provide the sensor input of the three-dimensional geographical position of one or more of the implements. The sensor input (e.g., GPS, etc.) may be associated with stored positioning data, such as maps, geo-coordinate markers, and so on, to reconcile the real-time machine and implement position in three-dimensional space with known objects and grade locations of preset location or work site. Each implement may be individually controlled by the control system based an operator input, sensor input, stored data or combination thereof.

In the case of coordinating the main blade of a motor grader with another implement, various aspects of a machine and implement positioning system may be incorporated into, or configured to work with, a separate blade control system. One known blade control system is available from Deere & Company of Moline, Ill., as an Integrated Grade Control (IGC) system, which generally is a blade control system using the combination of sensor input (e.g., GPS) and stored data (e.g., maps). The IGC system may also allow for operator control of an initial position setting, such as an initial height of the blade. The IGC system may also allow for a combination of operator and automated position control. For example, the height of one end (e.g., the toe end) of the blade may be initially or continuously under the control of the operator via a suitable control interface (e.g., joystick controls), and the height of the other end (e.g., the heel end) of the blade may be controlled automatically according to sensor and stored data input. In this way, the cross-slope (i.e., the heel-toe lateral orientation) of the blade can be precisely controlled to set the prescribed grade at a particular location.

Having received a position input for a primary implement (e.g., the main blade), the control system will coordinate the position of one or more other (secondary or subordinate) implements based on a relative orientation of the primary implement position input. For example, the control system will determine a location offset from the primary implement and translate the primary position input to a position movement of a secondary implement that corresponds to the primary implement position input. The control system may effect a secondary implement position movement that is a one for one direct translation of the primary implement position input, or the control system may effect a secondary implement position movement that is offset from the primary implement position input in one or more dimensions or degrees of freedom.

In a motor grader having a primary blade and a front blade, for example, the control system may receive an input, from an operator, sensor, stored data, or a combination thereof, to position the main blade. The control system will then position the front blade automatically (i.e., without operator intervention) based on the main blade position input. The main blade position input may be a geo-coordinate input from a GPS system, for example, which the control system uses to position the main blade according to a stored data, such as a terrain map of the work site. Based on the main blade position input, the control system will position the front blade.

As mentioned, the control system can provided coordinated positioning of the secondary implement according to various schemes, which may vary based on the implement set being controlled and/or the work being completed. In some embodiments, the control system may coordinate the position of the secondary implement to have a like position in one or more dimensions. For example, in a multi-blade arrangement, the control system may position the secondary blade to have the same height as the primary blade. In a subset of such embodiments, the secondary blade will be different, at least in part, in one or more dimensions in addition to the offset dimension. For example, a front blade may be positioned such that occupies a different lateral position, at least in part, from that of the primary blade (and in addition to the offset position in the fore-aft dimension). Thus, in these cases, the front and main blades will act as a single, longer blade in the lateral dimension, and thereby, extend the effective reach of either blade individually. In other embodiments, the control system may position the secondary implement at an offset position with respect to the primary implement. The offset position may be a complementary (e.g., mirror) position with respect to the primary implement. For example, the control system may position the front blade to have an equal or unequal opposite (e.g., positive or negative) slope compared to that of the main blade. In this way, the blades may be controlled to create a crowned profile in a single pass of the machine. Still further, in some embodiments, the offset position may simply a different position in one or more dimensions. For example, a front blade may be positioned at an elevated position with respect to the height of the main blade to knock down hills or mounds in advance of the grade-setting operation performed by the main blade. And in a blade and scarifier arrangement, for example, the scarifier, located in front of the main blade, may be operated simultaneously with the main blade and have its height, or penetration depth into the ground, coordinated to the position of the main blade. The scarifier may be automatically positioned lower than the main blade to break up ground in advance of the grade-setting operation of the main blade. Various combinations of like and offset positioning may be provided by the coordinated control system of this disclosure.

The control system may coordinate the position of more than two implements. The control system may coordinate the position of third, fourth, fifth or more implements with the primary implement position input and/or the derived position of the secondary implement. For example, a multi-blade arrangement, such as may be useful for snow removal from roadways and the like, may have a main blade, a front blade, and left and right side blades. The control system may coordinate the position of the front and side blades to have a like position with respect to the height position of the main blade and offset, at least in part, with respect to the lateral position of the main blade. The lateral slope and steer angle of the front and one of the side blades may also be coordinated with like orientation as the main blade. However, the relative size, mounting location and positioning of the various blades will be such that the front and side blades have different lateral positions than the main blade. In this way, the front and side blades may serve as an extension of the main blade in the lateral dimension. Other combinations of three or more blade and/or non-blade implements may also be operated in a coordinated manner by the disclosed control system.

As noted, the disclosure provides a coordinated control system and method that facilitates operator control of multiple implements of a work vehicle. It should be understood, however, that whatever the implements are, or which implement is considered the primary (or secondary, tertiary, quaternary, etc.) implement, the control system of this disclosure may allow for separate (or non-coordinated) control of the individual implements based on separate control inputs to each implement or sub-set of implements.

With reference to the drawings, one or more example implementations of the operator control arrangement will now be described. While a motor grader is illustrated and described herein as an example work vehicle, one skilled in the art will recognize that principles of the coordinated control system and method disclosed herein may be readily adapted for use in other types of work vehicles, including, for example, various crawler dozer, loader, backhoe and skid steer machines used in the construction industry, as well as various other machines used in the agriculture and forestry industries. As such, the present disclosure should not be limited to applications associated with motor graders or the particular example motor grader shown and described.

As shown in FIGS. 1A-1B, in one example of a motor grader 10, a main frame 12 supports an operator cabin 14 and a power plant 16 (e.g., a diesel engine) operably coupled to power a drive train. The main frame 12 is supported off of the ground by ground-engaging steered wheels 18 at the front of the machine and by two pairs of tandem drive wheels 20 at the rear of the machine. A circle 30 and main blade 32 assembly is mounted to the main frame 12 in front of the operator cabin 14 by a drawbar 34 and a lifter bracket 36, which in certain embodiments may be pivotal with respect to the main frame 12. A front blade 40 is mounted to the front of the main frame 12 by a six-way mounting assembly 42. The power plant 16 may power one or more hydraulic pumps 50, which pressurize hydraulic fluid in a hydraulic circuit including various electro-hydraulic valves 52, and various hydraulic actuators 54 for the main blade 32 and various hydraulic actuators 56 for the front blade 40. In the following discussion of one example embodiment, the main blade 32 is considered the primary implement, the position of which is commanded by operator or other input and used as the basis to automatically set the position of the secondary implement, which in the example is the front blade 40. It will be understood that the front blade 40 or another implement of the motor grader 10 may serve as the primary implement, and the main blade 32 may be controlled automatically.

In the illustrated example, the various actuators 54, 56 may be configured as rotating drives and linear actuators, such as one or more hydraulic cylinders. The actuators 54 may include a rotating hydraulic drive **54*a* for rotating the circle 30 about a generally vertical axis to set the steer angle of the main blade 32. The actuators 54 may also include lift cylinders 54***b* for raising and lowering the circle 30 and main blade 32 and setting the toe-to-heel slope of the main blade 32, a shift cylinder 54*c* for shifting the main blade 32 laterally, and a pitch cylinder 54*d* for setting the pitch angle of the main blade 32. The actuators 56 for the front blade 40 may include lift cylinders 56*a* for raising and lowering the front blade 40 and setting its slope, a steer cylinder 56*b* for rotating the front blade 40 about a generally vertical axis to set its steer angle, and a shift cylinder 56*c* for shifting the front blade 40 laterally. In other configurations, other movements of the main and front blades 32, 40 may be possible. Further, in some embodiments, a different number or configuration of hydraulic cylinders or other actuators may be used. Thus, it will be understood that the configuration of the motor grader 10, and the circle 30 and main blade 32 assembly and the front blade 40 and mounting assembly 42, are presented as an example only.

As noted, the motor grader 10 includes one or more pumps 50, which may be driven by the engine of the motor grader 10. Flow from the pumps 50 may be routed through the various control valves 52 via various conduits (e.g., flexible hoses) in order to drive the hydraulic drives and cylinders 54*a*-54*d*, 56*a*-56*c*. Flow from the pumps 50 may also power various other components of the motor grader 10. The flow from the pumps 50 may be controlled in various ways (e.g., through control of the various control valves 52), in order to cause movement of the hydraulic drives and cylinders 54*a*-54*d*, 56*a*-56*c*, and thus, the blades 32, 40 relative to the main frame 12. In this way, for example, movement of the blades 32, 40 into various positions may be implemented by various control signals to the pumps 50 and the control valves 52.

The operator cabin 14 provides an enclosure for an operator seat and an operator console for mounting various control devices (e.g., steering wheel, accelerator and brake pedals), communication equipment and other instruments used in the operation of the motor grader 10, including an operator interface 60 providing graphical (or other) input controls and feedback. The operator interface 60 may be configured in a variety of ways. In some embodiments, the operator interface 60 may include one or more joysticks, various switches or levers, one or more buttons, a touch-screen interface that may be overlaid on a display, a keyboard, a speaker, a microphone associated with a speech recognition system, or various other human-machine interface devices.

In certain embodiments, control inputs from the operator interface 60 may be velocity inputs providing corresponding velocity-based outputs to control the electro-hydraulic valves. As one of skill in the art will appreciate, a velocity-based input and output control scheme tracks not only the binary state of the control input (e.g., positional or on/off state), but also the rate at which the control input was made. For example, in a velocity-based control scheme, the control input takes account of the end position when the joystick is pivoted to as well as the rate at which the joystick was pivoted. The velocity inputs corresponding to a desired movement of the machine or implement may be resolved, possibly in conjunction with inputs from sensors or other actual position-indicating devices, to command one or more target actuator velocities (e.g., depending on the number of actuators required to effect the desire movement) to effectuate the end movement. A short duration joystick movement to a particular position may thus correspond to a relatively quicker and/or shorter movement of the associated actuator to a certain position, than a longer duration joystick movement. One benefit of this type of control scheme is an intuitive sense of control for the operator without requiring a detailed appreciation of the movement envelope of the associated machine or tool, or mapping of its position within the envelope to the joystick movement. Advantageously, in this type of system, control of each of multiple actuators may be aggregated by the controller to effect the desired movement, rather than requiring the operator to input distinct actuator commands for each discrete actuator. Another benefit of a velocity-based control scheme is that it allows the operator to make the intended control input (e.g., joystick movement) and then let the control (e.g., joystick) to return to center without continuing to hold the joystick in the desired position until the actuator movement cycle time is completed, as may be required in a position-based control scheme. Of course, it should be understood that the disclosed operator controls may have one or more (even all) of the control inputs configured according to a position-based control scheme.

The operator interface 60 is operatively connected to one or more controllers, such as controller 62. The operator interface 60 provides control inputs to the controller 62, which cooperates to control various of the associated electro-hydraulic valves to actuate the various drives and actuators 54, 56 of the hydraulic circuit. The controller 62 may provide operator feedback inputs to the operator interface 60 for various parameters of the machine, implement(s) or other sub-systems. Further, the operator interface 60 may act as an intermediary between other operator controls and the controller 62 to set, or allow the operator to set or select, the mapping or functionality of one or more of controls (e.g., switches or joystick movements) of the operator controls.

The controller 62 (or others) may be configured as a computing device with associated processor devices and memory architectures, as a hard-wired computing circuit (or circuits), as a programmable circuit, as a hydraulic, electrical or electro-hydraulic controller, or otherwise. As such, the controller 62 may be configured to execute various computational and control functionality with respect to the motor grader 10 (or other machinery). In some embodiments, the controller 62 may be configured to receive input signals in various formats (e.g., as hydraulic signals, voltage signals, current signals, and so on), and to output command signals in various formats (e.g., as hydraulic signals, voltage signals, current signals, mechanical movements, and so on). In some embodiments, the controller 62 (or a portion thereof) may be configured as an assembly of hydraulic components (e.g., valves, flow lines, pistons and cylinders, and so on), such that control of various devices (e.g., pumps or motors) may be effected with, and based upon, hydraulic, mechanical, or other signals and movements.

The controller 62 may be in electronic, hydraulic, mechanical, or other communication with various other systems or devices of the motor grader 10 (or other machinery). For example, the controller 62 may be in electronic or hydraulic communication with various actuators, sensors, and other devices within (or outside of) the motor grader 10, including various devices associated with the pumps 50, control valves 52, and so on. The controller 62 may communicate with other systems or devices (including other controllers) in various known ways, including via a CAN bus (not shown) of the motor grader 10, via wireless or hydraulic communication means, or otherwise. An example location for the controller 62 is depicted in FIG. 1. It will be understood, however, that other locations are possible including other locations on the motor grader 10, or various remote locations.

Various sensors may also be provided to observe various conditions associated with the implements (e.g., the blades 32, 40) of the motor grader 10. In some embodiments, various sensors 72 may be disposed on or near the blades 32, 40, or elsewhere on the motor grader 10. For example, a GPS 70 may include one or more transceiver units mounted directly to the main blade 32. Various other sensors, such as additional 72*a*-72*c* for the main blade 32 and sensors 72*d*-72*f* for the front blade 40, may also be disposed on or near the circle 30 and the front blade mounting assembly 42. In some embodiments, the sensors 72*a*-72*f* may include angle sensors to detect rotational angle orientations of the circle 30 and/or the blades 32, 40, linear sensors to detect the "length" of an associated cylinder of the circle 30 and/or the blades 32, 40, or microelectromechanical sensors (MEMS) that observe a force of gravity and an acceleration associated with the circle 30 and/or the blades 32, 40. The various components noted above (or others) may be utilized to control movement of the blades 32, 40 via control of the movement of the one or more hydraulic actuators 54, 56. Accordingly, these components may be viewed as forming part of the coordinated control system and method for the motor grader 10. Each of the sensors 72 may be in communication with the controller 62 via a suitable communication architecture.

In the illustrated example, the motor grader 10 has an Integrated Grade Control (IGC) system, which is a high-precision blade control system using GPS and stored terrain map data. As noted, the IGC system may also allow for operator control of an initial position setting, such as an initial height of the blade, and for a combination of operator and automated position control. In this way, the height and cross-slope (i.e., the heel-toe lateral orientation) of the main blade 32 can be precisely controlled to set the prescribed grade at a particular location.

In various embodiments, the controller 62 outputs one or more control signals or control commands to the actuators 54, 56 associated with the blades 32, 40 based on one or more of the sensor signals received from the sensors 72 and/or input received from the operator interface 60, and further based on the coordinated control system and method of the present disclosure. The controller 62 outputs the one or more control signals or control commands to the pumps 50 and/or control valves 52 associated with hydraulic actuators 54, 56 based on one or more of the sensor signals received from the sensors 72 and input received from the operator interface 60.

Figure 2:
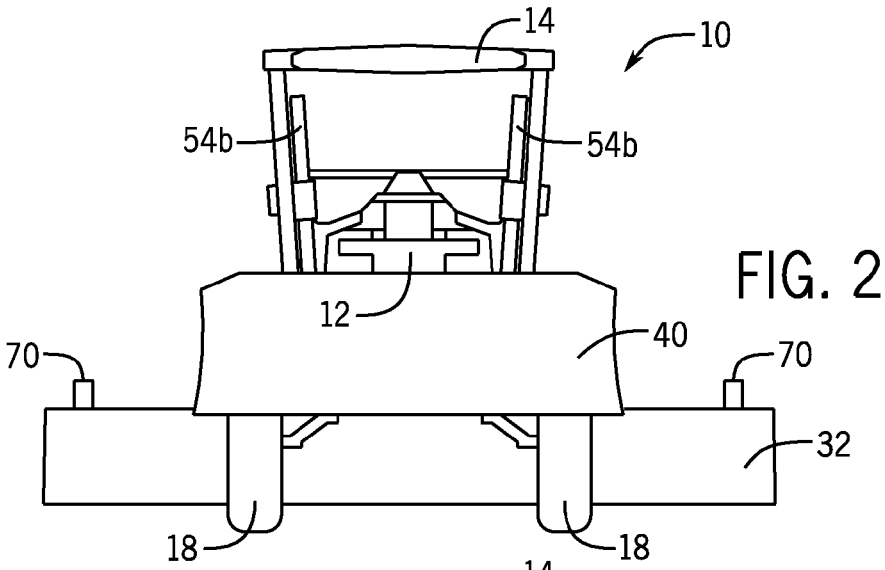
FIG. 2 is a front view thereof.

Referring also to FIG. 2, a dataflow diagram illustrates various embodiments of a coordinated implement control system 100 for the motor grader 10, which may be embedded within the controller 62. Various embodiments of the control system 100 according to the present disclosure may include any number of other modules or sub-modules embedded within the controller 62 that may be combined and/or further partitioned. Inputs to the control system 100 may be received from the GPS 70 and the sensors 72*a*-72*f*, operator interface 60, and other control modules (not shown) associated with the motor grader 10, and/or determined/modeled by other sub-modules (not shown) within the controller 62 (or other controllers). In various embodiments, the controller 62 includes an input/output (I/O) module 102, a user interface (UI) module 104, an IGC module 106, a coordinated control (CC) module 108, an implement command (IC) module 110, a map data store 112 and a translation data store 114. In the example embodiment, the CC module 108 operates in conjunction with the IGC module 106 and only operates to perform the implement coordination function when the IGC module is active. It should be understood, however, that the IGC module 106 may not be present, or the IGC module 106 and the CC module 108 may each operate independently.

The I/O module 102 and the UI module 104 receive input data from one or more sources. The I/O module 102 may receive input data 116 in the form of coordinate signals from the GPS 70 and input data 118 in the form of feedback signals from one or more of the sensors 72*a*-72*d* associated with the actuators 54, 56. The UI module 104 receives input data from the operator via the operator interface 60. The input data may include a mode input 120 to initiate the IGC system or a position input 122 to command a movement of the blades 32, 40. The UI module 104 may also output one or more notifications to the operator interface 60 (e.g., in the form of audible, tactile and/or visual notifications) to notify the operator of the implement control mode, for example, including a manual mode indicator 130, an IGC mode indicator 132 and a CC mode indicator 134. The UI module 104 may output other data to the operator, including for example, geographical location coordinators or map data 136 with the current position of the motor grader 10.

The I/O module 102 or the UI module 104 interprets the input data for a command to position either of the blades 32, 40. In certain embodiments, when an input corresponds to the front blade 40, which, as noted above, is characterized by the control logic as a "secondary" implement, the IC module 110 resolves the input into a value 140 associated with "manually" positioning of the front blade 40. The term "manual" (and derivatives) are used herein to mean being controlled by the operator, for example, via the operator interface 60. In some embodiments, the value 140 may be a duration for which a control valve 52 is held open to allow hydraulic flow to one of the actuators 56. The IC module 110 then generates a command 142 to the front blade 40, which includes the value 140. The I/O module 102, the UI module 104 and the IC module 110 receive and process the various inputs 116, 118, 122 to position the front blade 40 as commanded. As one example, the controller 62 may command 142 the actuator 56*a* to lower the front blade 40, while receiving feedback from the associated sensor 72*d* to monitor and terminate positioning. Thus, as explained, the operator or other input may command positioning of the front blade 40 (i.e., the secondary implement) directly and independent of the main blade 32 (i.e., the primary implement). The UI module 104 may output the manual mode indicator 130 momentarily or during the manual positioning of the front blade 40.

In certain embodiments, when an input corresponds to the main blade 32, again the primary implement, the I/O module 102 ascertains (e.g., by interrogating the UI module 104) whether the mode input 120 has been received corresponding to a command for initiation of the IGC system (i.e., whether the controller 62 is in IGC mode). If not in IGC mode, the IC module 110 resolves the input data into a value 144 associated with "manually" positioning of the main blade 32. The value 144, for example, may be a duration for which a control valve 52 is held open to allow hydraulic flow to one of the actuators 54. The IC module 110 then generates a command 146 to the main blade 32, which includes the value 144. The I/O module 102, the UI module 104 and the IC module 110 receive and process the various inputs 116, 118, 122 to position the front blade 40 as commanded. As one example, the controller 62 may command 146 the actuator 54*a* to rotate the circle 30 to reorient the steer angle of the main blade 32, while receiving feedback from the associated sensor 72*a* to monitor and terminate rotation. In this way, the operator or other input may command positioning of the main blade 32 (i.e., the primary implement) directly and independent of the front blade 40 (i.e., the secondary implement). The UI module 104 may again output the manual mode indicator 130 momentarily or during the manual positioning of the main blade 32.

In certain embodiments, when in IGC mode, the IGC module 106 accesses the map data store 112 and interprets the map or geographical coordinate signals corresponding to the GPS data 116 to determine the position of the main blade 32. The IGC module 106 operates to provide real-time or near real-time monitoring and position adjustments of the main blade 32 as the motor grader 10 travels over the terrain. As is understood in the art, without operator input, the IGC module 106 may control the position of the main blade 32 precisely, including the height, slope, steer angle, side-shift, pitch, again, based on location signals from one or multiple transceivers of the GPS 70 mounted directly to the main blade 32 and the map data store 112. The IGC module 106 may also allow for external input (e.g., operator or other sensor input) to override or otherwise control the position of the main blade 32 in one or more aspects. For example, the IGC module 106 may allow the operator, via the operator interface 60, to control one of the lift actuators 54*b* (e.g., a right side lift actuator) while the IGC module 106 controls the other lift actuator 54*b* (e.g., a left side lift actuator) to permit blade height adjustments while maintaining a consistent cross-slope of the main blade 32. The IC module 110 resolves the associated IGC values 144 and generates the associated commands 146 to the main blade 32.

While in IGC mode, the CC module 108 initiates to control the front blade 40 based on the input for the main blade 32. In certain embodiments, the CC module 108 translates the input data for the main blade 32 (i.e., the primary implement) into input data for the front blade 40 (i.e., the secondary implement). The CC module 108 accesses the translation data store 114 in making the input translation. The translation data store 114 may include information related to the configuration and position of the front blade 40, including one or more of: physical dimensions of each blade 32, 40, the mounting position of the front blade 40 on the main frame, the measured fore-aft, lateral and/or height distances of its mounting location on the main frame 12 relative to the mounting location of the main blade 32, home or other preselected positions of the blades 32, 40, and range of motion information for the blades 32, 40. Thus, the translation data store 114 may include x-coordinate, y-coordinate, and z-coordinate information of each of the blades 32, 40 for the controller 62 to construct, or be provided with, a coordinate mapping of the front blade 40 relative to the main blade 32.

Figure 2A:
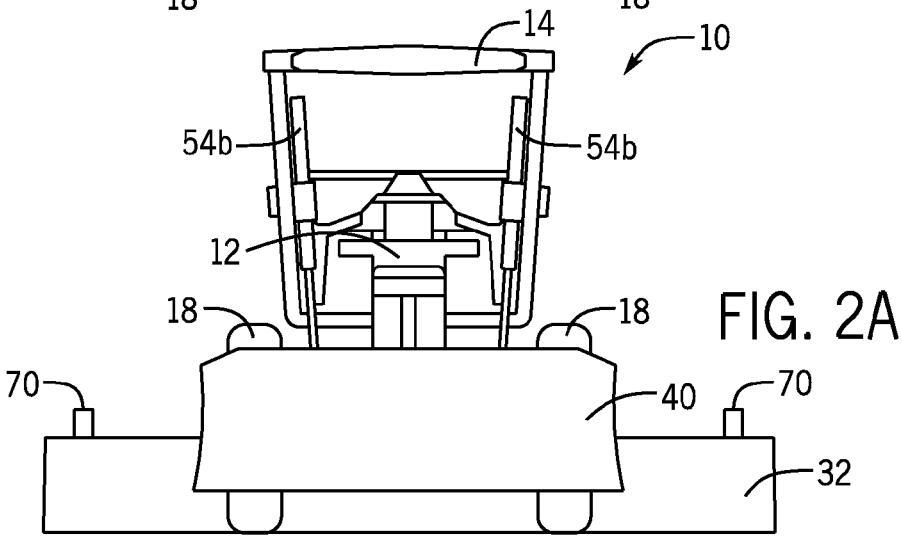
FIGS. 2A-2D are front views similar to FIG. 2 showing the front blade and the main blade in different relative orientations.
Figure 2B:
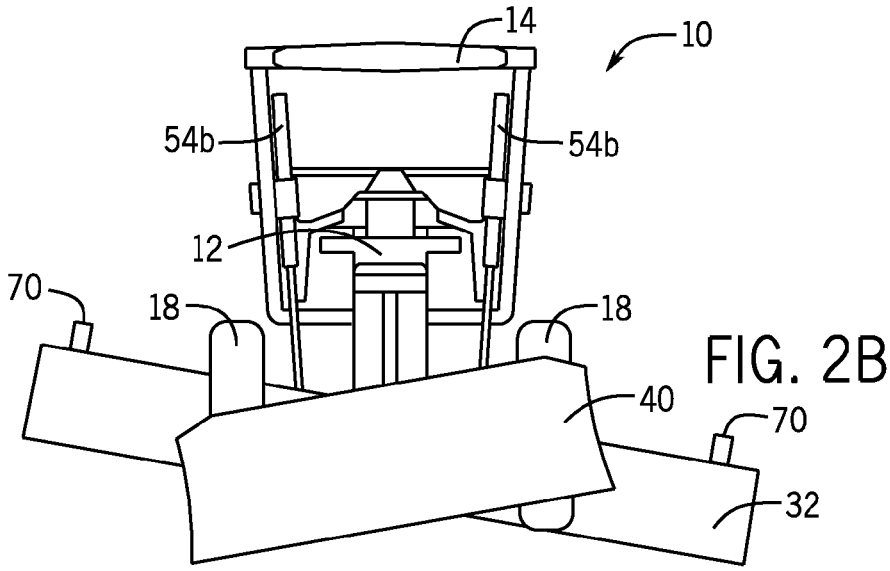
Figure 2C:
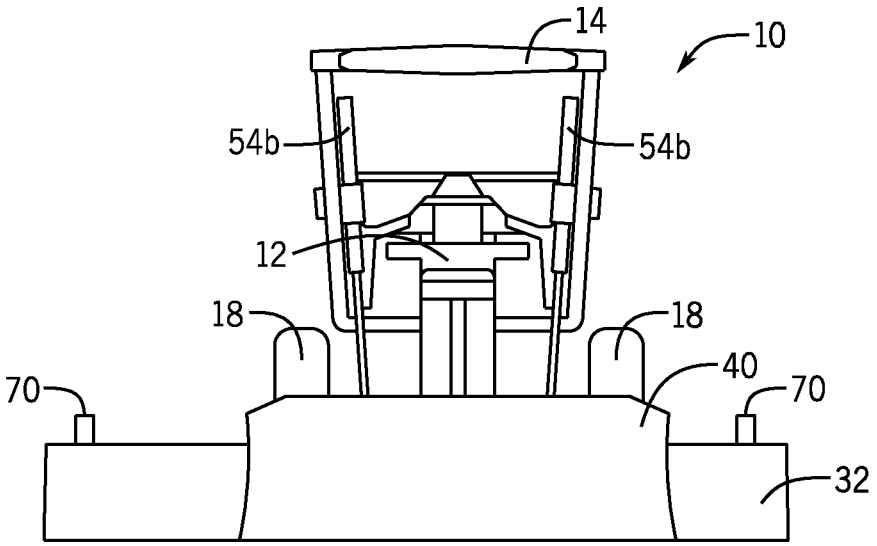
Figure 2D:
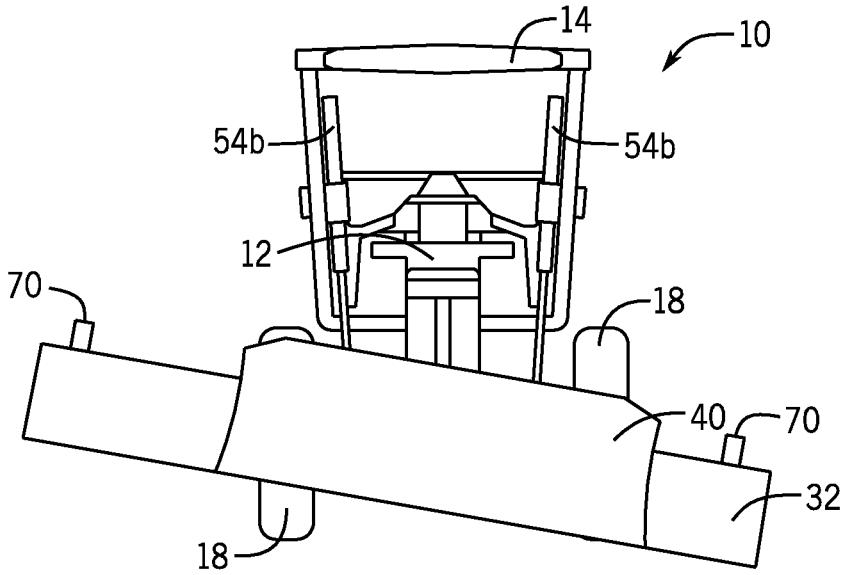

The translation data store 114 may also include information or instructions regarding the nature in which the secondary implement should be coordinated to the primary implement. The secondary implement may be coordinated in such a way that its position is offset from the primary implement in one or more dimensions or angular orientations. Alternatively, the secondary implement may be coordinated in such a way that its position aligns or otherwise matches that of the primary implement in one or more dimensions or angular orientations. For example, as shown in FIG. 2A, the height of the front blade 40 may be at a coordinated offset of that of the main blade 32. A raised offset of the front blade 40 relative to the main blade 32 may be beneficial for knocking down hills or other raised objects or obstructions before reached by the main blade 32. As another example shown in FIG. 2B, the front blade 40 may be offset angularly from the main blade 32, at the same or a different height. A mirror or other counter-angle orientation of the front blade 40 relative to a sloped orientation of the main blade 32 may be beneficial to allow the motor grader 10 to create a crowned grade in a single pass. As noted, the blades 32, 40 may be aligned in certain orientations. For example, as shown in FIG. 2C, the front blade 40 may be set at the same height as the main blade 32, and the front blade 40, the main blade 32 or both may be shifted laterally from the centered position. This has the effect of elongating or extending the reach of the main blade 32. As shown in FIG. 2D, the blades 32, 40 may be coordinated to have the same or similar cross-slope as well. The blades 32, 40 may also be at the same or different pitches and/or steer angles.

Based on the instructions or information from the translation data store 114, the IC module 110 resolves the associated coordinated values 140 and generates the associated commands 142 to the front blade 40. The CC module 108 may operate concurrently or consecutively with the IGC module 106, and the front blade 40 may be positioned concurrently or consecutively with the positioning of the main blade 32. And again, it should be understood that, while in this example embodiment the CC module 108 performs the implement coordination function only when the IGC mode is active, the CC module 108 may operate independently of the IGC module 106 or other such control system.

Figure 4:
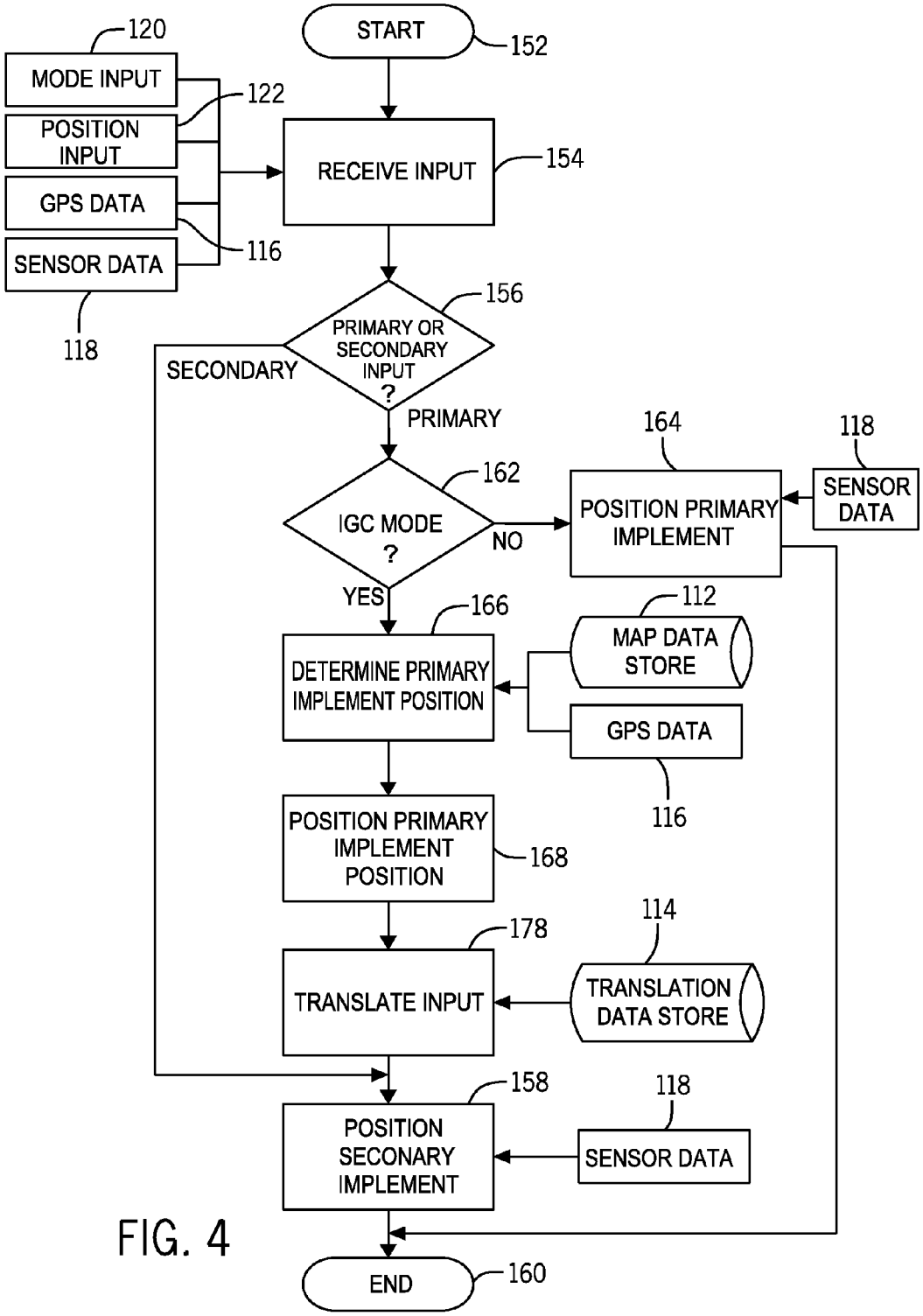
FIG. 4 is a flowchart for an example coordinated implement control method.

Referring now also to FIG. 4, a flowchart illustrates a coordinated implement control method 150 that may be performed by the control system 100 in accordance with the present disclosure. As can be appreciated in light of the disclosure, the order of operation within the method 150 is not limited to the sequential execution as illustrated in FIG. 4, but may be performed in one or more varying orders as applicable and in accordance with the present disclosure.

In one example, the method begins at 152. At 154, the controller 62 receives the input data 116, 118, 122, and at 156 determines whether the input data 116, 118, 122 includes an input for positioning the secondary implement (e.g., the front blade 40). If the controller 62 determines that a secondary implement input has been input, the method proceeds, at 158, to generate the necessary commands (e.g., to the hydraulic pumps 50, control valves 52 and/or actuators 56) to position the secondary implement (e.g., the front blade 40) according to the input provided. The controller 62 may receive feedback or other position indicating signals in the sensor data 118 received from one or more of the sensors 72*a*-72*fg* associated with the front blade 40. The controller 62 may use timers or other devices or techniques for achieving the commanded position without feedback. Although not shown in FIG. 4, it should be understood that the method 150 may loop back to 154 and 158 to perform successive or continuous positioning of the front blade 40 as needed. When the commanded position has been achieved, the method may end at 160.

If at 156 the controller 62 determines that the position input was associated with positioning the primary implement (e.g., the main blade 32), then the method proceeds to 162 where the controller 62 determines whether the mode input 120 was received indicating initiation of the IGC mode. If not, the method continues to 164 to position the primary implement (e.g., the main blade 32) by generating the necessary commands (e.g., to the hydraulic pumps 50, control valves 52 and/or actuators 54) to position the primary implement (e.g., the main blade 32) according to the input provided. The controller 62 may receive feedback or other position indicating signals in the sensor data 118 received from one or more of the sensors 72*a*-72*c* associated with the main blade 32. The controller 62 may use timers or other devices or techniques for achieving the commanded position as well. While not shown in FIG. 4, the method could also use the GPS data 116 in positioning the main blade 32, even if IGC mode is not active. Also not shown in FIG. 4, it should be understood that the method 150 may loop back to 154 and 164 to perform successive or continuous positioning of the main blade 32 as needed. When the commanded position has been achieved, the method may end at 160.

If at 162 the controller 62 determines that the system is in IGC mode, the method may proceed to 166 at which it determines the current position of the primary implement (e.g., the main blade 32) using the GPS data 116 with reference to the coordinate or map data in the map data store 112. The method proceeds to 168 to position the primary implement (e.g., the main blade 32) by generating the necessary commands (e.g., to the hydraulic pumps 50, control valves 52 and/or actuators 54) to position the primary implement (e.g., the main blade 32) according to the input provided. The controller 62 may receive feedback or other position indicating signals from the GPS 70 as well as input from the sensor data 118 received from one or more of the sensors 72*a*-72*c* associated with the main blade 32. The controller 62 may use timers or other devices or techniques for achieving the commanded position as well. While not shown in FIG. 4, it should be understood that the method 150 may loop back to 154, 166 and 168 to perform successive or continuous positioning of the main blade 32 as needed.

The method continues, simultaneously or consecutively with step 168, to 170 at which the controller 62 translates the primary implement input into a secondary implement input. The controller 62 processes the information and instructions in the translation data store 114 to map the position to the secondary implement, for example, mapping x-, y- and/or z-coordinates from the physical mounting location of the main blade 32 to the front blade 40. The controller 62 also processes the information in the translation data store 114 for instructions to apply a position offset or position matching algorithm, such as in the manner described above, such that the secondary implement is coordinated based on a direct translation of the primary implement input or based on an offset translation of the primary implement input. The method proceeds, at 158, to generate the necessary commands (e.g., to the hydraulic pumps 50, control valves 52 and/or actuators 56) to coordinate the position the secondary implement (e.g., the front blade 40) according to the input provided for the primary implement (e.g., the main blade 32). The controller 62 may receive feedback or other position indicating signals in the sensor data 118 received from one or more of the sensors 72*d*-72*f* associated with the front blade 40. The controller 62 may use timers or other devices or techniques for achieving the commanded position without feedback. Although not shown in FIG. 4, it should be understood that the method 150 may loop back to 154 to perform successive or continuous coordinated positioning of the front blade 40 with respect to the main blade 32, as needed. When the coordinated position has been achieved, the method may end at 160.

Figure 5:
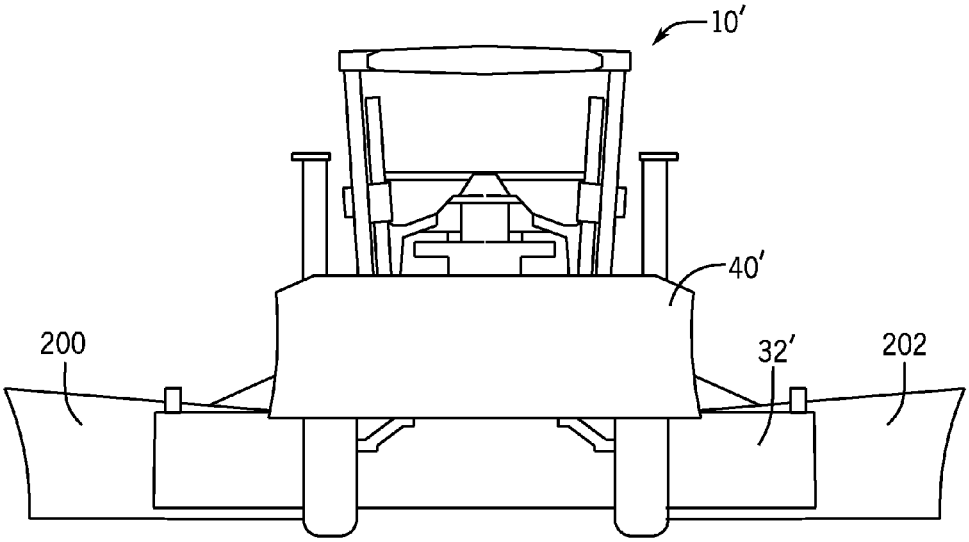
FIG. 5 is a front view of another example work machine in the form of a motor grader, having multiple implements in form of a main blade, side blades and a front blade, in which the disclosed coordinated implement control system and method may be used.
Figure 5A:
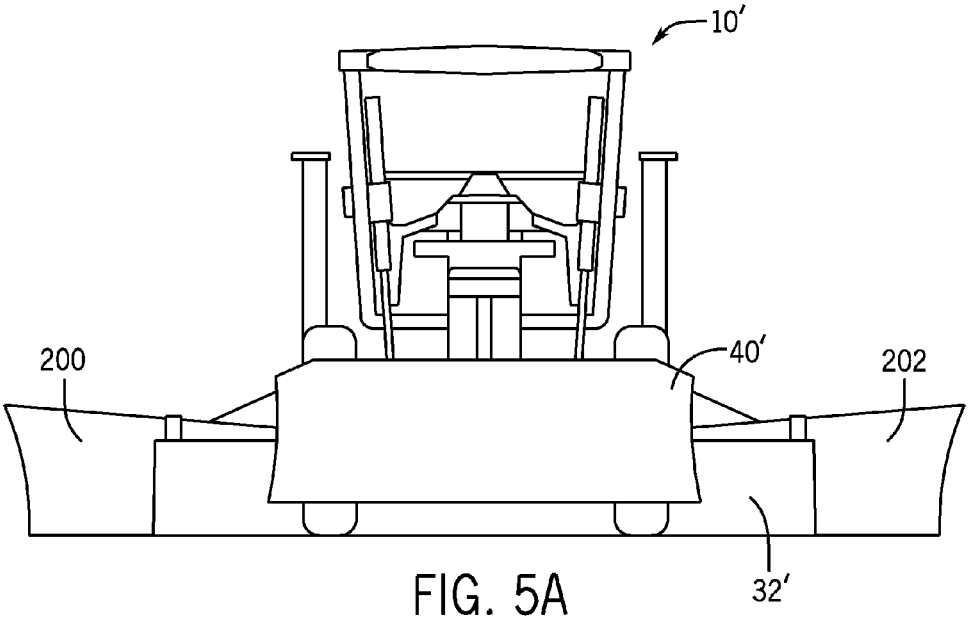
FIG. 5A is a front view similar to FIG. 5 showing the main blade, side blades and front blade in a different relative orientation.
Figure 6:
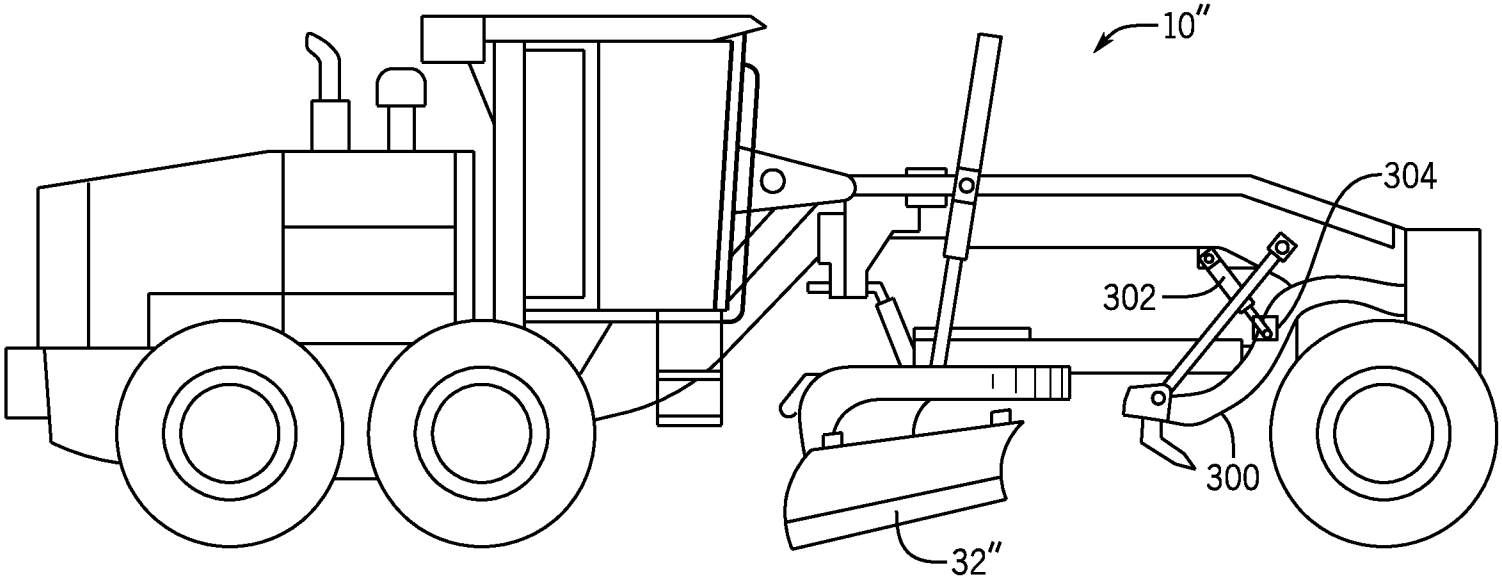
FIG. 6 is a side view of another example work machine in the form of a motor grader having multiple implements in the form of a blade and a scarifier in which the disclosed coordinated implement control system and method may be used.
Figure 7:
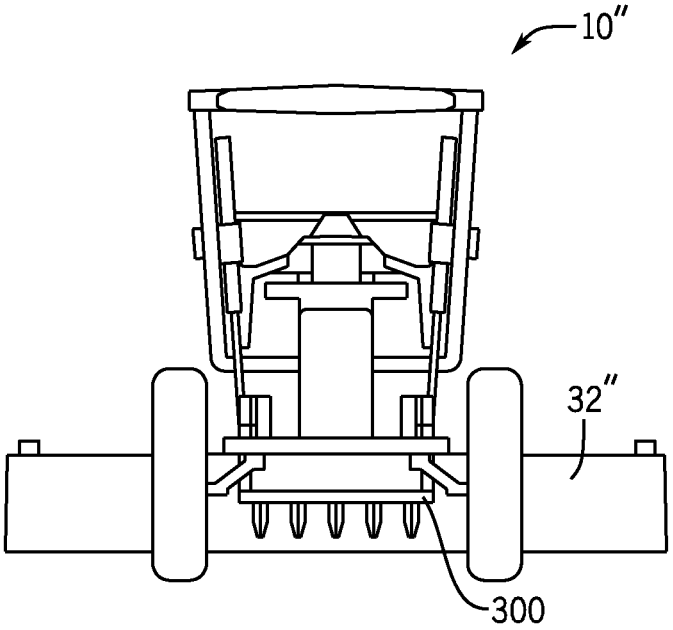
FIG. 7 is a front view thereof.
Figure 7A:
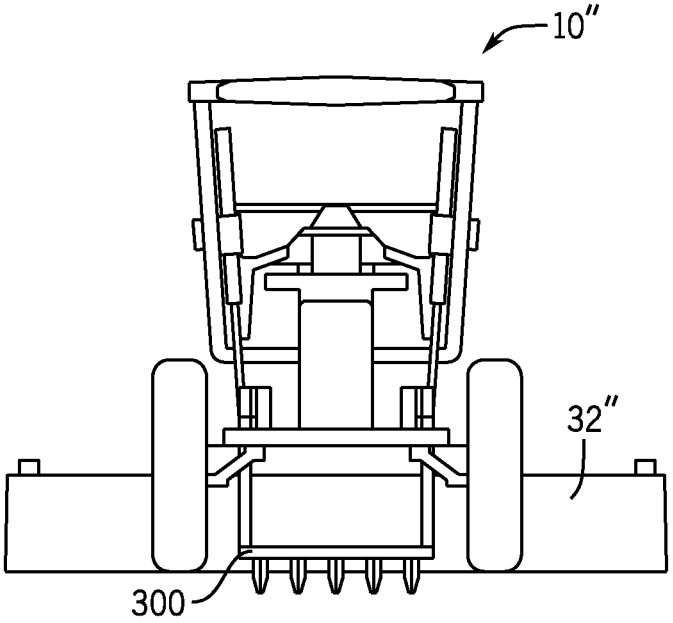
FIG. 7A is a front view similar to FIG. 7 showing the main blade and scarifier in a different relative orientation.

Examples of the control system and method have been described above with respect to an example motor grader 10 having two implements, specifically main blade 32 and front blade 40. It will be understood that the disclosed control system and method may be applicable to coordinated implements in other machines having a different type and/or number of implements. For example, FIGS. 5 and 5A illustrate an example motor grader having four implements in the form of four blades, and FIGS. 6-7A illustrate an example motor grader having two different types of implements, namely a blade and a scarifier. The additional examples shown in FIGS. 5-7A will be described briefly. It should be understood that the motor grader and various actuation and sensor components may be the same as described above. Thus, for brevity, only the pertinent parts of these additional examples will be described, and for clarity, like reference numbers, with one or more prime symbols, will be used for parts corresponding to the aforementioned example(s).

Figure 3:
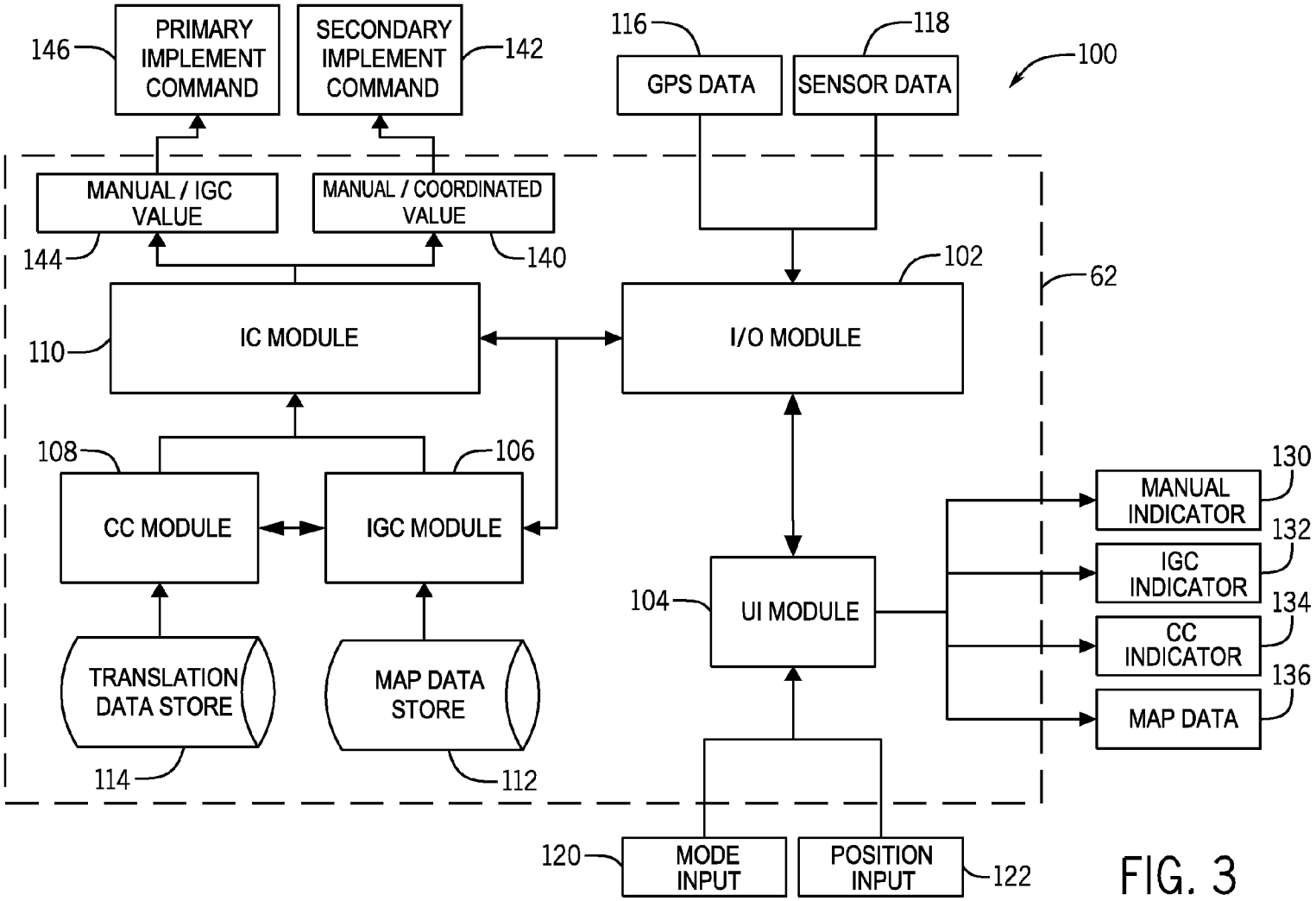
FIG. 3 is a dataflow diagram for an example coordinated implement control system.

FIGS. 5-5A show a motor grader 10' having a primary implement in the form of a main blade 32', a secondary implement in the form of a front blade 40', a tertiary implement in the form of a first side blade 200 and a quaternary implement in the form of a second side blade 202. Each of the implements is operatively coupled to the controller (see FIG. 3) and the hydraulic system (see FIG. 1) and may have associated control valves, actuators, and sensors (not shown). The controller, such as via the IGC module, CC module and the IC module, is configured to translate a primary implement input signal as needed to generate control commands for the front blade 40' and the side blades 200, 202. The translation data store (see FIG. 3) may include information and instructions pertaining to the difference in physical dimensions and mounting positions of the side blades 200, 202 relative to the main blade 32' and/or the front blade 40'. The translation data store may also provide information and instructions regarding whether a direct translation or an offset translation should be applied to the side blades 200, 200, and in which degree(s) of freedom the side blades 200, 202 should be aligned or offset from the main blade 32'. Further, in examples such as this in which there are more than two implements, the controller may be provided (such as in the translation data store) with a different instruction set, such that one or more implements (e.g., the side blades 200, 202) may be positioned at the same height and slope as the main blade 32', while one or more other implements (e.g., the front blade 40') may be at an offset height, such shown in FIG. 5A. Moreover, with more than two implements, the controller may be provided (such as in the translation data store) with a hierarchy structure for the implements. In that case, one or more of the non-primary implements (e.g., the front blade 40') may be characterized as a "primary" implement with respect to one or more subordinate implements (e.g., the side blades 200, 202). Thus, the disclosed control system and method may coordinate the positioning of three or more implements.

FIGS. 6-7A show a motor grader 10" having a primary implement in the form of a main blade 32" and a secondary implement in the form of a scarifier 300. Each of the implements is operatively coupled to the controller (see FIG. 3) and the hydraulic system (see FIG. 1) and may have associated control valves, actuators, and sensors, including actuator 302 and sensor 304 associated with positioning the height (or penetration depth) of the scarifier. The controller, such as via the IGC module, CC module and the IC module, is configured to translate a primary implement input signal as needed to generate control commands for the scarifier 300. The translation data store (see FIG. 3) may include information and instructions pertaining to the difference in physical dimensions and mounting position of the scarifier 300 relative to the main blade 32". The translation data store may also provide information and instructions regarding whether a direct translation or an offset translation should be applied to the scarifier 300, and in which degree(s) of freedom the scarifier 300 should be aligned or offset from the main blade 32". For example, as shown in FIG. 7A, the scarifier may be positioned at an offset translation orientation in which the height is lower than the main blade, such that its teeth penetrate the ground below the bottom edge of the main blade 32", which may be useful for breaking up hard ground in advance of a main blade grading operation. Thus, the disclosed control system and method may coordinate the positioning of two or more implements of different types.

As will be appreciated by one skilled in the art, certain aspects of the disclosed subject matter can be embodied as a method, system (e.g., a work vehicle control system included in a work vehicle), or computer program product. Accordingly, certain embodiments can be implemented entirely as hardware, entirely as software (including firmware, resident software, micro-code, etc.) or as a combination of software and hardware (and other) aspects. Furthermore, certain embodiments can take the form of a computer program product on a computer-usable storage medium having computer-usable program code embodied in the medium.

Any suitable computer usable or computer readable medium can be utilized. The computer usable medium can be a computer readable signal medium or a computer readable storage medium. A computer-usable, or computer-readable, storage medium (including a storage device associated with a computing device or client electronic device) can be, for example, but is not limited to, an electronic, magnetic, optical, electromagnetic, infrared, or semiconductor system, apparatus, or device, or any suitable combination of the foregoing. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device. In the context of this document, a computer-usable, or computer-readable, storage medium can be any tangible medium that can contain, or store a program for use by or in connection with the instruction execution system, apparatus, or device.

A computer readable signal medium can include a propagated data signal with computer readable program code embodied therein, for example, in baseband or as part of a carrier wave. Such a propagated signal can take any of a variety of forms, including, but not limited to, electromagnetic, optical, or any suitable combination thereof. A computer readable signal medium can be non-transitory and can be any computer readable medium that is not a computer readable storage medium and that can communicate, propagate, or transport a program for use by or in connection with an instruction execution system, apparatus, or device.

Aspects of certain embodiments are described herein can be described with reference to flowchart illustrations and/or block diagrams of methods, apparatus (systems) and computer program products according to embodiments of the invention. It will be understood that each block of any such flowchart illustrations and/or block diagrams, and combinations of blocks in such flowchart illustrations and/or block diagrams, can be implemented by computer program instructions. These computer program instructions can be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions can also be stored in a computer-readable memory that can direct a computer or other programmable data processing apparatus to function in a particular manner, such that the instructions stored in the computer-readable memory produce an article of manufacture including instructions which implement the function/act specified in the flowchart and/or block diagram block or blocks.

The computer program instructions can also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

Any flowchart and block diagrams in the figures, or similar discussion above, can illustrate the architecture, functionality, and operation of possible implementations of systems, methods and computer program products according to various embodiments of the present disclosure. In this regard, each block in the flowchart or block diagrams can represent a module, segment, or portion of code, which comprises one or more executable instructions for implementing the specified logical function(s). It should also be noted that, in some alternative implementations, the functions noted in the block (or otherwise described herein) can occur out of the order noted in the figures. For example, two blocks shown in succession (or two operations described in succession) can, in fact, be executed substantially concurrently, or the blocks (or operations) can sometimes be executed in the reverse order, depending upon the functionality involved. It will also be noted that each block of any block diagram and/or flowchart illustration, and combinations of blocks in any block diagrams and/or flowchart illustrations, can be implemented by special purpose hardware-based systems that perform the specified functions or acts, or combinations of special purpose hardware and computer instructions.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A coordinated implement control method for a work vehicle having a primary implement and a secondary implement, the method comprising:

receiving, by one or more controllers, a primary implement position input;

generating, by the one or more controllers, a primary implement control command to drive one or more primary actuators to position the primary implement according to the primary implement position input; and generating, by the one or more controllers, a secondary implement control command that is coordinated with the primary implement position input;

wherein the secondary implement control command is generated to drive one or more secondary actuators to position the secondary implement in a relative orientation that is coordinated with respect to an orientation of the primary implement resulting from the primary implement control command.

2. The method of claim 1, wherein the primary implement is a primary blade and the secondary implement is a secondary blade.

3. The method of claim 1, wherein the primary implement is a blade and the secondary implement is a scarifier.

4. A coordinated blade control method for a motor grader having a primary blade and a secondary blade, the method comprising:

receiving, by one or more controllers, a primary blade position input;

generating, by the one or more controllers, a primary blade control command to drive one or more primary actuators to position the primary blade according to the primary blade position input; and generating, by the one or more controllers, a secondary blade control command that is coordinated with the primary blade position input;

wherein the secondary blade control command is generated to drive one or more secondary actuators to position the secondary blade in a relative orientation that is coordinated with respect to an orientation of the primary blade resulting from the primary blade control command.

5. The method of claim 4, wherein the relative orientation of the secondary blade is the same as the orientation of the primary blade in at least one degree of freedom.

6. The method of claim 5, wherein the at least one degree of freedom includes a height, a cross-slope, a steering angle, a pitch and a sideways position of the primary blade; and wherein the relative orientation of the secondary blade corresponds to at least one of the height, the cross-slope, the steering angle, the pitch and the sideways position of the primary blade.

7. The method of claim 6, wherein the relative orientation of the secondary blade has the same height and cross-slope as the orientation of the primary blade; and wherein the orientation of the primary blade has a shifted sideways position with respect to the relative orientation of the secondary blade.

8. The method of claim 4, wherein the relative orientation of the secondary blade corresponds to an offset height and cross-slope substantially parallel to the orientation of the primary blade.

9. The method of claim 4, wherein the primary blade control command drives the one or more primary actuators differently than the second blade control command drives the one or more secondary actuators.

10. The method of claim 4, wherein the primary blade position input is a stored command; and wherein the stored primary blade position input is correlated to a geo-position marker of the primary blade.

11. The method of claim 4, wherein the primary blade position input is an operator input command.

12. The method of claim 4, wherein the primary blade position input is a sensed input from one or more primary sensors associated with the one or more primary actuators.

13. The method of claim 4, wherein the motor grader has tertiary and quaternary blades, and further including:

generating, by the one or more controllers, tertiary and quaternary blade control commands that are coordinated with the primary blade position input;

wherein the tertiary and quaternary blade control commands are generated to drive respective one or more tertiary and quaternary actuators to position the tertiary and quaternary blades in relative orientations with respect to the orientation of the primary blade resulting from the primary blade control command.

14. The method of claim 4, further including:

receiving, by the one or more controllers, a secondary blade position input that is different than the primary blade position input; and generating, by the one or more controllers, a secondary blade control command according to the secondary blade position input.

15. A coordinated multi-blade control system for a motor grader having a primary blade and a secondary blade, the blade control system comprising:

one or more controllers configured to:

receive a primary blade position input;

generate a primary blade control command to drive one or more primary actuators to position the primary blade according to the primary blade position command; and generate a secondary blade control command that is coordinated with the primary blade position input;

wherein the secondary blade control command is generated to drive one or more secondary actuators to position the secondary blade in a relative orientation that is coordinated with respect to an orientation of the primary blade resulting from the primary blade control command.

16. The system of claim 15, wherein the relative orientation of the secondary blade is the same as the orientation of the primary blade in at least one degree of freedom including a height, a cross-slope, a steering angle, a pitch and a sideways position of the primary blade.

17. The system of claim 15, wherein the relative orientation of the secondary blade corresponds to an offset height and cross-slope substantially parallel to the orientation of the primary blade.

18. The system of claim 15, wherein the primary blade position input is one or more of: a stored input, a GPS input, an operator input and a sensed input.

19. The system of claim 18, further including:

one or more primary sensors associated with the one or more primary actuators;

wherein the one or more controllers receive the primary blade position input from the one or more primary sensors.

20. The system of claim 15, wherein the motor grader has tertiary and quaternary blades; and wherein the one or more controllers are further configured to generate tertiary and quaternary blade control commands that are coordinated with the primary blade position input, the tertiary and quaternary blade control commands being generated to drive respective one or more tertiary and quaternary actuators to position the tertiary and quaternary blades in relative orientations with respect to the orientation of the primary blade resulting from the primary blade control command.

* * * * *